United States Patent [19]

Kobuki et al.

[11] 3,996,904

[45] Dec. 14, 1976

[54] THROTTLE POSITIONER

[75] Inventors: Shinzo Kobuki; Masaru Hase, both of Toyota, Japan

[73] Assignee: Toyota Jidosha Kogyo Kabushiki Kaisha, Toyota, Japan

[22] Filed: July 30, 1975

[21] Appl. No.: 600,140

[30] Foreign Application Priority Data

Mar. 20, 1975 Japan ..... 50-33803

[52] U.S. Cl. ..... 123/103 R; 123/97 R; 261/DIG. 19

[51] Int. Cl.[2] ..... F02D 11/08

[58] Field of Search ..... 261/DIG. 19; 123/97 R, 123/97 B, 103 R

[56] References Cited

UNITED STATES PATENTS

| | | | |
|---|---|---|---|
| 3,547,089 | 12/1970 | Pierlot | 261/DIG. 19 |
| 3,596,642 | 8/1971 | Nakata | 123/97 B |
| 3,721,222 | 3/1973 | Shioya | 123/103 R |
| 3,744,470 | 7/1973 | Clarke | 123/103 R |

*Primary Examiner*—Ronald H. Lazarus
*Attorney, Agent, or Firm*—Birch, Stewart, Kolasch & Birch

[57] ABSTRACT

A throttle positioner adapted to be operated by an intake vacuum system to maintain a throttle valve at a throttle opening position for a predetermined time when an accelerating pedal has been released while an automobile is running, wherein a vacuum control valve is provided to selectively nullify said intake vacuum operating system as long as the rotational speed of an engine is above a predetermined level, said vacuum control valve being controlled by delivery air pressure of an air pump driven by the engine.

5 Claims, 1 Drawing Figure

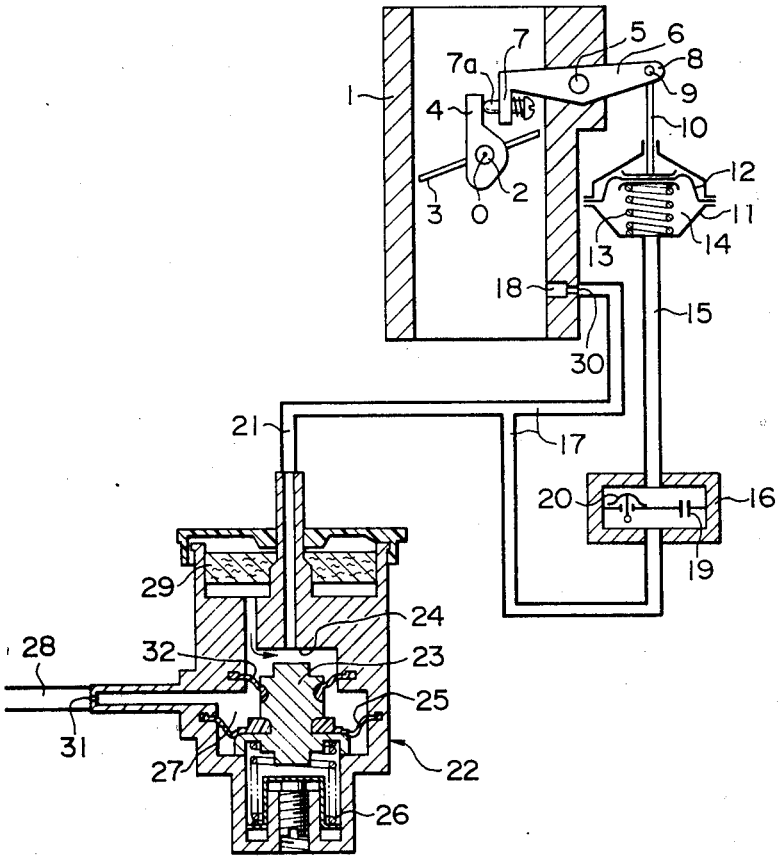
1
2
3
4
5
6
7
7a
8
9
10
11
12
13
14
15
16
17
18
19
20
21
22
23
24
25
26
27
28
29
30
31
32

THROTTLE POSITIONER

BACKGROUND OF THE INVENTION

1. Field of the Invention

The present invention relates to a throttle positioner and, more particularly, an improvement thereof with regard to its performance.

2. Description of the Prior Art

When an automobile is decelerated while it is running, the amount of uncombusted components in the exhaust gas significantly increases. In order to solve this problem, a device which is called a throttle positioner has been proposed. The throttle positioner operates to hold a throttle valve at a predetermined opening position where it is slightly opened from an idling position when an automobile is decelerated, thereby maintaining a predetermined minimum amount of air supply through an intake tube, thus avoiding heavy emission of uncombusted material in the exhaust gas.

Conventionally, the throttle positioner comprises a port to detect intake vacuum, a diphragm means, a conduit means which connects said port and said diaphragm means, said conduit means including a means to delay transmission of vacuum, a throttle positioning lever adapted to be driven by said diaphragm means so as to rotate between first and second rotary positions, and a throttle driving lever mounted on a rotary shaft of a throttle valve and adapted to engage a tip of said throttle positioning lever so as to hold return of the throttle valve at a predetermined opening position when said throttle positioning lever is in said first rotary position while disengaging from said tip of said throttle positioning lever so as to allow for full return of the throttle valve to an idling position when said throttle positioning lever is in said second rotary position. In a throttle positioner of the aforementioned kind, when an automobile is running at a constant speed or being accelerated with the throttle valve being turned to a relatively large opening position, the intake vacuum detected by said port is relatively low (small) and, accordingly, the diaphragm is loosened in one direction thereby turning said throttle positioning lever to said first rotary position. If, in this condition, the accelerating pedal is released to decelerate the automobile, thereby rotating the throttle valve toward its closing position, said throttle driving lever mounted to the rotary shaft of the throttle valve engages said tip of the throttle positioning lever, whereby the throttle valve is checked from returning to its idling position and is maintained at a throttle opening position where the throttle valve is slightly opened from the idling position. When the throttle valve has been closed to said throttle opening position, the intake vacuum detected by said port rapidly increases up to a relatively large value. The increased intake vacuum is transmitted to the diaphragm chamber of the diaphragm means through said means to delay transmission of vacuum with a predetermined time delay effected by said delay means. Then, as the intake vacuum applied to the diaphragm chamber gradually increases, the diaphragm means is tightened in a direction opposite to the aforementioned loosening direction, thereby correspondingly turning the throttle positioning lever toward said second rotary position. After the lapse of a predetermined time from the beginning of deceleration, said time being adjusted by said means to delay transmission of vacuum, the throttle positioning lever reaches said second rotary position and the tip of the throttle positioning lever disengages from the throttle driving lever, whereby the throttle valve is released from the restriction applied by the throttle positioning lever and is permitted to return to its idling opening position.

Now, in the case of a modern autombile which is equipped with an oxidizing catalytic converter in its gas exhausting system for the purpose of purifying exhaust gases, there is a problem in that if the throttle positioner is released after a relatively short lapse of time, thereby turning the throttle valve to its idling position when the automobile is running on a relatively long downhill slope, a relatively large amount of uncombusted components are emitted in the exhaust gas, said components being combusted in the oxidizing catalytic converter thereby causing overheating of the converter.

SUMMARY OF THE INVENTION

It is the primary object of the present invention to solve the abovementioned problem and to provide an improved throttle positioner for use with an automobile equipped with an oxidizing catalystic converter, wherein the throttle positioner is adapted to operate, as a conventional throttle positioner, to maintain a throttle valve at a throttle opening position which is slightly opened from an idling position for a predetermined time when an accelerating pedal has been released to return the throttle valve toward its fully closed position, during running of an automobile and, in addition, to operate in a different manner to maintain the throttle valve at the throttle opening position even after the lapse of said predetermined time as long as an engine is rotating at a rotational speed above a predetermined level in spite of release of the accelerating pedal.

According to the present invention, the abovementioned object is accomplished by a throttle positioner comprising a port to detect intake vacuum, a diaphragm means, a conduit means which connects said port and a diaphragm chamber of said diaphragm means, said conduit means including a means to delay transmission of vacuum, a throttle positioning lever adapted to be driven by said diaphragm means so as to rotate between first and second rotary positions, and a throttle driving lever mounted on a rotary shaft of a throttle valve and adapted to engage a tip of said throttle positioning lever so as to hold return of the throttle valve at a predetermined opening position when said throttle positioning lever is in said first rotary position while disengaging from said tip of said throttle positioning lever so as to permit full return of the throttle valve to an idling position when said throttle positioning lever is in said second rotary position, characterized by a vacuum control valve which selectively opens an intermediate portion of said conduit means to the atmosphere, said vacuum control valve being controlled by delivery air pressure of an air pump driven by an engine so as to open when the air pressure is above a predetermined level.

An automobile equipped with an exhaust gas purifying system usually includes an air pump which is driven by an engine for supplying air to be injected into a gas exhausting system. The delivery air pressure of the air pump is generally proportional to the rotational speed of the engine. Therefore, the level of the delivery air pressure of the air pump can be employed as a signal which represents the rotational speed of the engine. The present invention utilizes this fact and contemplates to control the throttle positioner directly by the delivery air pressure of the air pump without incorporating a complicated control system such as detecting the rotational speed of the engine by a tachometer, whereby a positive control system which controls the throttle positioner in the aforementioned manner is obtained in a very simple structure.

BRIEF DESCRIPTION OF THE DRAWING

The sole FIGURE in the attached drawing is a rather schematical sectional view of an embodiment of the throttle positioner according to the present invention.

DESCRIPTION OF THE PREFERRED EMBODIMENT

Referring to the drawing, 1 designates an intake passage portion of a carburetor, in which a throttle valve 3 is mounted by a rotary shaft 2 to be rotatable around an axis 0. A throttle driving lever 4 is mounted to the rotary shaft 2 for the throttle valve. A throttle positioning lever 6 is mounted to be rotatable about a pivot shaft 5 with its one end 7 equipped with an adjusting screw 7*a* being positioned adjacent a free end of the throttle driving lever 4 to be selectively engageable therewith. Another end 8 of the throttle positioning lever 6 is connected with a diaphragm 12 of a diaphragm means 11 by way of a pivot pin 9 and a link element 10. The diaphragm 12 is applied with an upward compression force by a compression coil spring 13. A diaphragm chamber 14 defined below the diaphragm 12 is connected with a port 18 which opens toward the inside of the intake passage portion 1 at a position substantially downstream of the throttle valve 3 via conduit 15, a vacuum delay valve 16 and another conduit 17. The vacuum delay valve 16 comprises an orifice and a check valve 20 arranged in parallel with each other and operates to apply a predetermined throttling action to fluid flowing from the conduit 15 toward the conduit 17 while permitting substantially free flow from the conduit 17 toward the conduit 15.

From an intermediate portion of the conduit 17 is branched a conduit 21 which is connected with a vacuum control valve 22. The vacuum control valve 22 comprises a valve structure composed of a valve member 23 and a valve seat 24 adapted to open or close an end of the conduit 21 and a diaphragm means including a diaphragm 25 which actuates the valve member 23 in the opening and closing directions. The diaphragm 25 is urged upward in the FIGURE by a compression coil spring 26 and is adapted to be urged downward with a diaphragm chamber 27 defined thereabove supplied with delivery air pressure of an air pump driven by an engine (both not shown) through a conduit 28 so as to be biased up and down according to the balance between the force of the compression coil spring 26 and the delivery air pressure of the air pump. Element 29 designates an air filter which purifies air to be introduced into the conduit 21 when the vacuum control valve 22 is opened by the valve member 23 being removed from the valve seat 24 by actuation of the diaphragm 25. Another diaphragm 32 is provided to define a part of the diaphragm chamber 27 while providing movability of the valve member.

The drawing shows the throttle positioner in a condition that the throttle valve 3 has just returned toward its fully closed position by rapid release of an accelerating pedal for effecting deceleration of an automobile while it is running at a relatively high speed. At the instant when the throttle valve 3 has returned to the position shown in the FIGURE, the engine is not yet substantially decelerated and the air pressure supplied to the diaphragm chamber 27 through the conduit 28 from the air pump driven by the engine is still maintained at a high level attained during running of the automobile before the throttle valve is closed. Therefore, the valve member 23 is maintained as lifted from the valve seat 24 and the vacuum control valve 22 is maintained in an open condition. Before the throttle valve is closed as shown in the FIGURE, since the vacuum applied to the port 18 is relatively low (small) and the vacuum control valve 22 is opened as shown in the FIGURE, the diaphragm chamber 14 of the diaphragm means 11 is supplied with substantially atmospheric pressure. Therefore, the diaphragm 12 is urged upward as seen in the FIGURE, by the compression coil spring 13 to take a loosened position, wherein the throttle positioning lever 6 is rotated counterclockwise as shown in the figure by way of the link element 10. In this position, the end 7*a* of the throttle positioning lever is positioned to traverse the rotating path of the free end of the throttle driving lever 4, whereby when the accelerating pedal has been released and the throttle valve 3 rotates toward its closing position, the throttle driving lever 4 engages with the throttle positioning lever 6 as shown in the FIGURE, thereby maintaining the throttle valve 3 at a throttle opening position as shown in the FIGURE which is slightly opened from an idling opening position.

If the throttle valve is closed to the throttle opening position as shown in the FIGURE while an automobile is running on a plane ground or climbing uphill, the engine instantly begins to decelerate and its rotational speed gradually lowers with corresponding gradual decrease of the air pump delivery pressure supplied to the diaphragm chamber 27 of the vacuum control valve 22. When the rotational speed of the engine has lowered below a predetermined level, the valve member 23 rests upon the valve seat 24 and closes the end of the conduit 21. On the other hand, from the instant when the throttle valve 3 has returned to the throttle opening position as shown in the FIGURE, a relatively high intake vacuum is applied to the port 18 and, after the vacuum control valve 22 has been closed in the aforementioned manner, said vacuum is gradually transmitted to the diphragm chamber 14 of the diaphragm means 11 through the orifice 19 of the vacuum delay valve 16. Thus, before a time determined by the throttling ratio of the orifice 19 and the operational condition of the engine lapses from the instant of releasing the accelerating pedal, the throttle valve 3 is maintained at the throttle opening position slightly opened from the idling position, thereby preventing a large amount of uncombusted components from being emitted in the exhaust gas by overthrottling of intake air. After the abovementioned time has lapsed, the diaphragm 12 is pulled downward against the compression coil spring 13 by the vacuum transmitted to the diaphragm chamber 14, whereby the throttle positioning lever 16 is rotated clockwise as seen in the FIGURE about the pivot shaft 5, thereby disengaging its end portion 7*a* from the tip of the throttle driving lever 4. Then, the throttle valve 3 further closes toward the idling position.

When the automobile is running on a long downhill slope, even if the throttle valve 3 is closed to the throttle opening position due to the release of the accelerating pedal, the engine maintains its relatively high rotation under the engine braking condition due to the potential energy of the total mass of the automobile and the driver and passengers, thereby maintaining a high level of the air pressure supplied to the diaphragm chamber 27 of the vacuum control valve through the conduit 28 from the air pump. Thus, the valve member 23 is maintained as lifted from the valve seat 24. In this case, therefore, even if a relatively high vacuum is applied to the port 18, the diaphragm chamber 14 of the diaphragm means 11 is maintained as opened to substantially atmospheric pressure through the conduit 21 and, therefore, the throttle positioning lever 6 is maintained at the rotational position as shown in the FIGURE. Therefore, when the automobile is running on a long downhill slope, the throttle valve is not returned to the idling position throughout the entire running of the automobile, thereby avoiding the danger of a large amount of uncombusted components being emitted into the gas exhaust system due to a shortage of intake air and an oxidizing catalytic converter being overheated.

An orifice 30 may be provided in the way of the conduit 17 to obtain a sharp switching-over operation of the vacuum control valve 22. Furthermore, an orifice 31 may be provided in the conduit 28 in order to eliminate pulsation in the air pump delivery pressure.

It should be understood that this invention is not limited to the particular embodiment shown and described hereinabove but that various changes and modifications may be made without departing from the spirit of the invention. We claim

1. A throttle positioner comprising a port to detect intake vacuum, a diaphragm means, a conduit means which connects said port and a diaphragm chamber of said diaphragm means, said conduit means including a means to delay transmission of vacuum, a throttle positioning lever adapted to be driven by said diaphragm means so as to rotate between first and second rotary positions, and a throttle driving lever mounted on a rotary shaft of a throttle valve and adapted to engage a tip of said throttle positioning lever so as to hold return of the throttle valve at a predetermined opening position when said throttle positioning lever is in said first rotary position while disengaging from said tip of said throttle positioning lever so as to permit full return of the throttle valve to an idling position when said throttle positioning lever is in said second rotary position, the improvement which comprises a vacuum control valve which selectively opens an intermediate portion of said conduit means to the atmosphere, said vacuum control valve being controlled by delivery air pressure of an air pump driven by an engine so as to open when the air pressure is above a predetermined level.

2. The throttle positioner of claim 1, wherein said vacuum control valve comprises a diaphragm which defines an end of a diaphragm chamber which is supplied with said delivery air pressure of said air pump, said diaphragm being adapted to be biased in a first direction by said air pump delivery pressure and to be biased in a second direction opposite to said first direction by a compression coil spring, said diaphragm being connected with a valve member adapted to rest upon a cooperating valve seat when the valve member is driven in said second direction, said valve seat being connected to said intermediate portion of said conduit means.

3. The throttle positioner of claim 2, wherein said diaphragm chamber is partly defined by a second diaphragm which maintains fluid tightness of said diaphragm chamber while permitting movability of said valve member.

4. The throttle positioner of claim 1, wherein a throttling orifice means is provided in the conduit means extending between said port and said intermediate portion.

5. The throttle positioner of claim 2, wherein a throttling orifice means is provided in a conduit which supplies said delivery air pressure of said air pump to said diaphragm chamber of said vacuum control valve.

* * * * *